United States Patent [19]

Jarnot

[11] Patent Number: 4,537,119

[45] Date of Patent: Aug. 27, 1985

[54] WEATHER PROTECTIVE COVER VENTILATOR

[75] Inventor: Frank R. Jarnot, Lantana, Fla.

[73] Assignee: Airlette Manufacturing Corporation, Inc., Lantana, Fla.

[21] Appl. No.: 608,170

[22] Filed: May 8, 1984

[51] Int. Cl.[3] ..... F24F 7/00

[52] U.S. Cl. ..... 98/52; 98/6; 98/37

[58] Field of Search ..... 98/2.14, 6, 13, 19, 98/29, 32, 37, 42 R, 52, 122; 206/815

[56] References Cited

U.S. PATENT DOCUMENTS

| | | | |
|---|---|---|---|
| 3,311,043 | 3/1967 | Atkinson | 98/37 |
| 3,651,983 | 3/1972 | Haugen | 206/815 X |
| 4,050,363 | 9/1977 | Fuerst | 98/37 |
| 4,184,414 | 1/1980 | Jarnot | 98/37 |

*Primary Examiner*—Harold Joyce
*Attorney, Agent, or Firm*—Harvey B. Jacobson

[57] ABSTRACT

An annular base having a central opening therein is provided for overlying and support from one side of a cover panel having a ventilation opening therein and with the base supported from the cover panel in at least reasonably good fluid tight sealed engagement with the portion of the cover panel extending about the opening. A cup-shaped cover is removably supported from the base and is somewhat resilient such that remote sidewalls of the cover may be inwardly deflected at the open end of the cover. Predetermined remote portions of the cover sidewall and corresponding remote portions of the base include coacting structure interlockingly engageable with each other upon return of the predetermined wall portions of the cover from inwardly deflected positions. The annular base defines an outstanding curb about the opening in the base and the closed end of the cover includes small ventilation openings therein and a central inwardly projecting stem from whose inner end a generally circular baffle is supported, the baffle being registered with the central opening in the base and of considerably larger plan area than that opening. Also, substantial portions of the periphery of the open end of the cover are spaced from the base to define air inlet slots and the base is provided with an adhesive coating on the side thereof remote from the cover for adhesive securement of the base to the cover panel from which the base is supported.

13 Claims, 9 Drawing Figures

Fig. 1
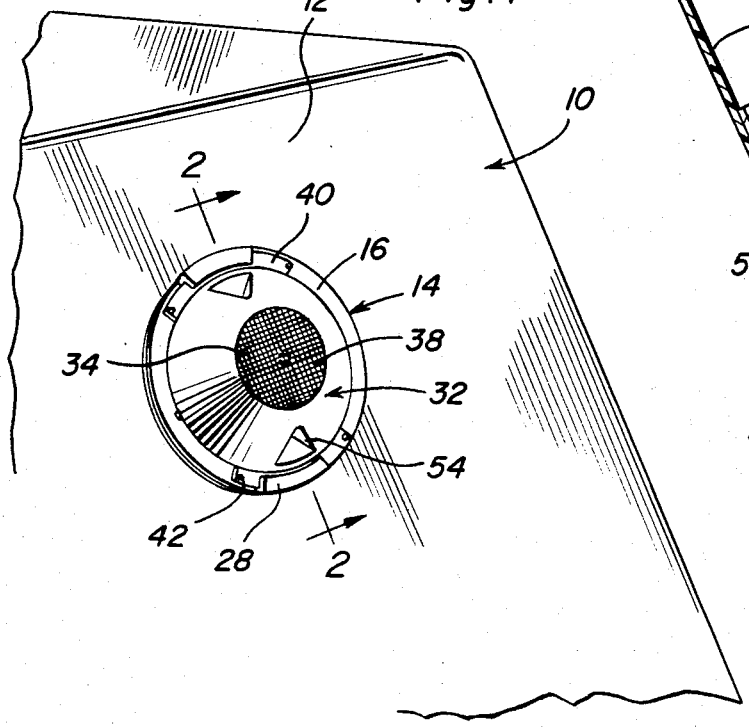
Fig. 2
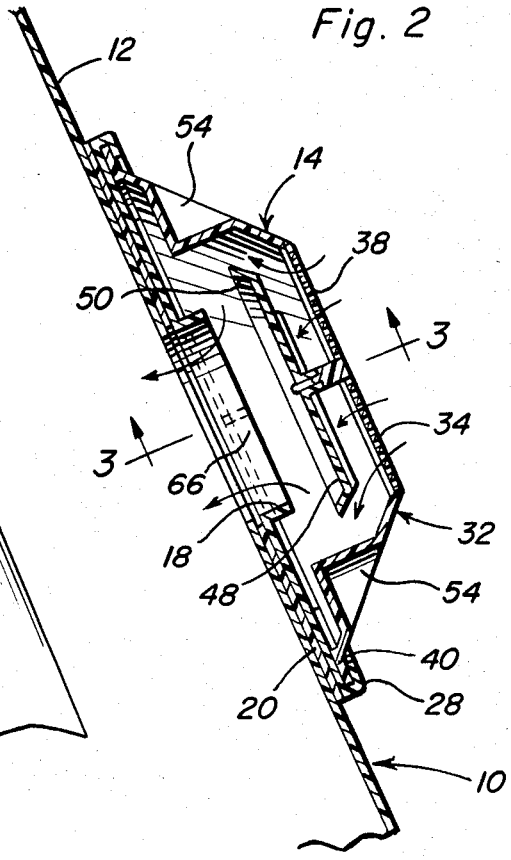
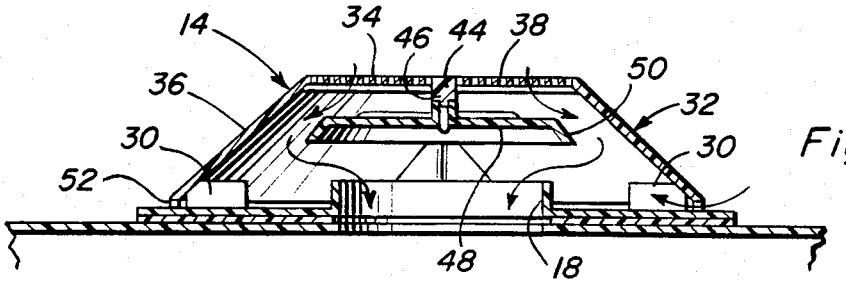
Fig. 3
Fig. 4
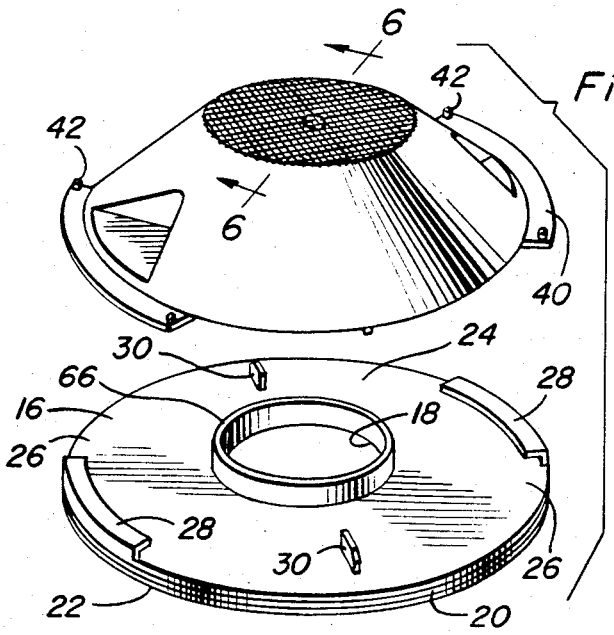
Fig. 5
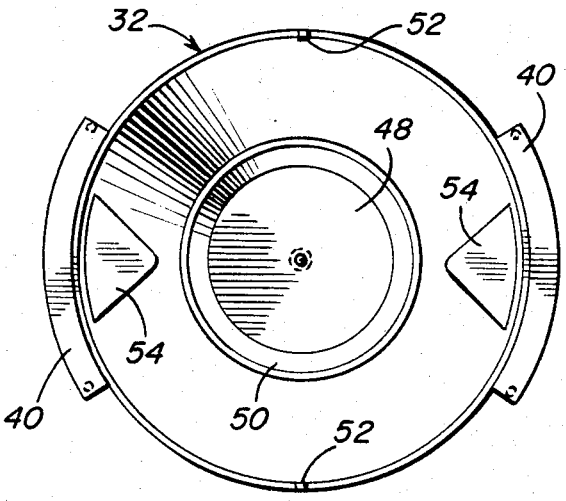

WEATHER PROTECTIVE COVER VENTILATOR

BACKGROUND OF THE INVENTION

In many instances, large flexible covers and/or tarpaulins are utilized to cover various objects for long periods of time. Covers and tarpaulins of this type are frequently required to incorporate ventilation openings in order to provide sufficient ventilation for object beneath the cover. However, cover and tarpaulin ventilation openings should be located at the highest angular section of the covering or tarpaulin and for this reason covers and tarpaulins are not preprovided with ventilation openings unless they are specially constructed for a particular object to be covered. Accordingly, when a cover or tarpaulin is to be placed over an object to be covered, inasmuch as it is important that ventilation openings be placed at or near the highest angular section of the covering, placement of the ventilation openings is best determined after the cover or tarpaulin has been placed in position.

Accordingly, a need exists for a cover or tarpaulin ventilator which may be readily applied to a cover in a desired position thereon after the cover has been placed over an object to be covered.

Various different forms of cover ventilators and other structures including some of the general structural and operational features of the instant invention are disclosed in my prior U.S. Pat No. 4,184,414 as well as U.S. Pat. Nos. 1,606,410, 2,601,820, 2,709,402, 2,713,210, 2,804,006, 3,012,812, 3,031,943, 3,049,836, 3,062,125, 3,164,078, 3,892,169 and 4,050,363.

BRIEF DESCRIPTION OF THE INVENTION

The ventilator of the instant invention includes an annular base having one side thereof provided with an adhesive coating whereby the base may be adhesively secured to a cover or tarpaulin in predetermined position thereon. The annular base defines a center opening therein through which the portion of the cover or tarpaulin to be ventilated may be cut in order to form a ventilation opening therein and the ventilator further includes a cup-shaped cover including a closed end having ventilation openings therein and a peripheral wall extending outward from the closed end. The peripheral wall is frusto-conical with its minor diameter end at the closed end of the cover and the cover is somewhat flexible whereby opposite peripheral wall portions may be inwardly deflected. The opposite peripheral wall portions of the cover and corresponding opposite peripheral portions of the annular base include coacting structure whereby the cover may be interlockingly supported from the base upon release of the inwardly deflected wall portions of the cover. Accordingly, the base of the ventilator may be quickly applied to the tarpaulin to be ventilated, the ventilation opening in the tarpaulin may be readily cut and the cover for the ventilator may be readily installed on the base.

The main object of this invention is to provide a ventilator for a cover or tarpaulin.

Another object of this invention is to provide a ventilator which may be applied to a tarpaulin after the tarpaulin has been plced over an object to be covered.

Still another object of this invention is to provide a ventilator in accordance with the preceding objects and which may be applied to the cover to be ventilated prior to the formation of a ventilation opening in the cover.

A further object of this invention is to provide a tarpaulin ventilator including structure whereby breezes blowing over the tarpaulin will greatly assist in the ventilation of the area beneath the tarpaulin.

A further object of this invention is to provide a tarpaulin ventilator which will be substantially weatherproof.

A final object of this invention to be specifically enumerated herein is to provide a tarpaulin ventilator in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

FIG. 1 is a fragmentary perspective view of a portion of a tarpaulin with a ventilator constructed in accordance with the present invention operatively associated therewith;

FIG. 2 is an enlarged fragmentary vertical sectional view taken substantially upon the plane indicated by the section line 2—2 of FIG. 1;

FIG. 3 is a fragmentary horizontal sectional view taken substantially upon the plane indicated by the section line 3—3 of FIG. 2;

FIG. 4 is an exploded perspective view of the ventilator;

FIG. 5 is a bottom plan view of the cover portion of the ventilator;

DETAILED DESCRIPTION OF THE INVENTION

Figure 6:
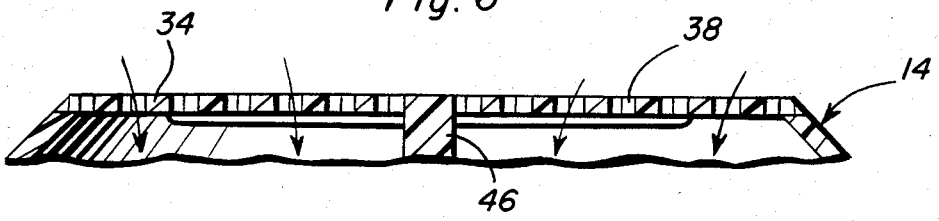
FIG 6 is an enlarged fragmentary vertical sectional view taken substantially upon the plane indicated by the section line 6—6 of FIG. 4.

Referring now more specifically to the drawings, the numeral 10 generally designates a tarpaulin which has been placed over an object (not shown) to be covered. An upper angular section 12 of the tarpaulin 10 supports a ventilator constructed in accordance with the present invention and referred to in general by the reference numeral 14. The ventilator 14 includes an annular base 16 which is generally planar in configuration and has a central opening 18 formed therein. The base 16 includes a lower side having an adhesive layer 20 disposed thereover and a cover or release sheet 22 is secured over the side of the layer 20 remote from the base 16. In addition, the upper side 24 of the base 16 includes diametrically opposite outer peripheral portions 26 including upwardly and inwardly directed right angle flanges 28 supported therefrom as well as diametrically opposite upstanding positioning and support flanges 30 projecting upwardly therefrom and disposed on a diameter of the base 16 disposed normal to the diameter of the base 16 containing the central portions of the flanges 28.

The ventilator 14 additionally includes a cup-shaped cover referred to in general by the reference numeral 32 and the cover 32 includes a circular end wall 34 and a peripheral wall 36 extending outwardly from the end wall 34. The peripheral wall 36 is frusto-conical with its minor diameter end closed by the end wall 34 and the end wall 34 includes a plurality of small ventilation openings 38 formed therethrough.

Diametrically opposite portions of the open end of the cover include outstanding, peripherally extending and coplanar arcuate flanges 40 of slightly greater angular extent than the flanges 28 and the opposite ends of each flange include upstanding pins 42. Further, the central area 44 of the end wall 34 is imperforate and supports an inwardly projecting shank 46 from whose inner end a disc-shaped shield 48 is supported. The shield 48 closely overlies the opening 18 and includes an outer frusto-conical peripheral flange 50.

With attention now invited more specifically to FIGS. 3 and 5 of the drawings, it may be seen that diametrically opposite portions of the major diameter end of the peripheral wall 36 include outwardly projecting spacing lugs 52 and that the peripheral wall 36 includes indentations 54 disposed on the diameter of the cover 32 centered relative to the flanges 40.

Figure 7:
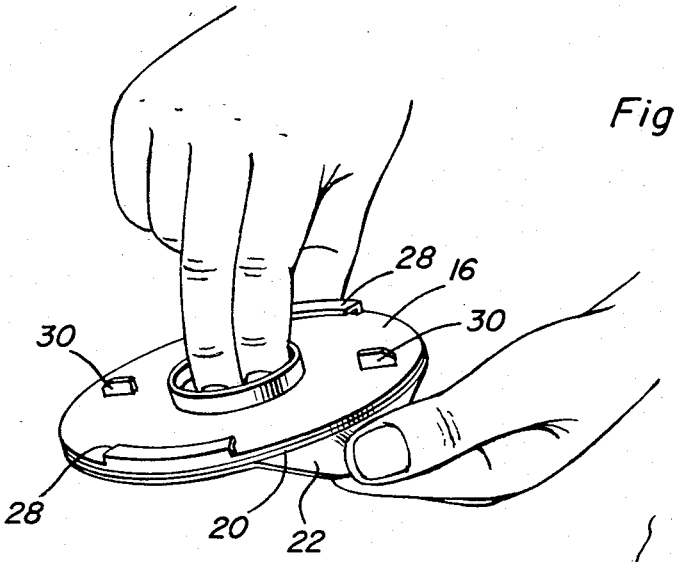
FIGS. 7, 8 and 9 are perspective views illustrating some of the various steps to be followed in securing the ventilator to a tarpaulin and forming a ventilation opening in the tarpaulin.
Figure 8:
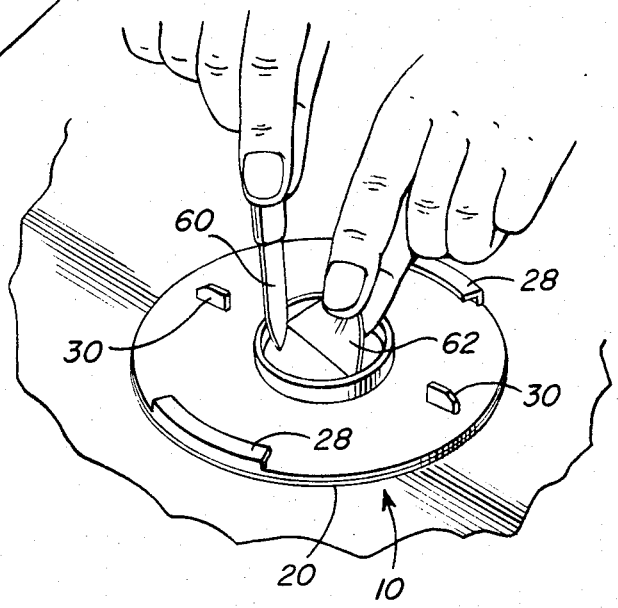
Figure 9:
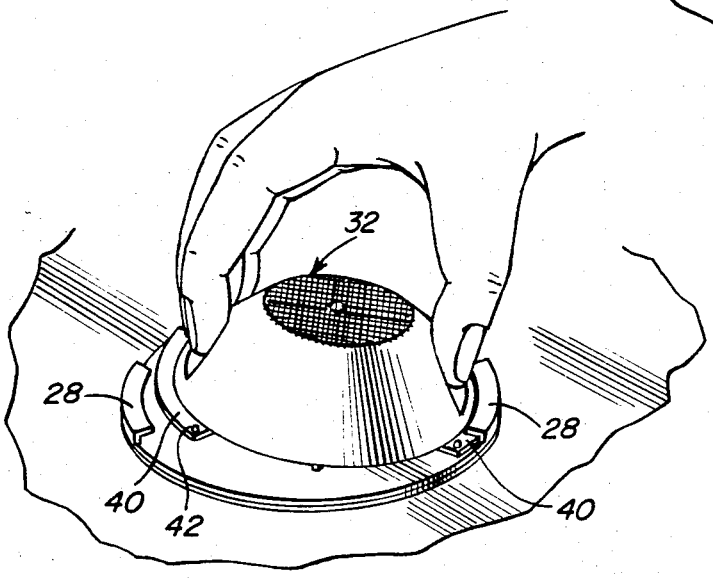

With attention now invited more specifically to FIGS. 7, 8 and 9 of the drawings, and upon the assumption that the tarpaulin 10 has already been placed over the object to be covered, the release sheet 22 is peeled from the adhesive layer 20 and the base 16 is placed in position on the section 12 of the tarpaulin 10 and pressed into position thereon in order to adhesively secure the base 16 to the tarpaulin in reasonably good fluid tight engagement therewith. Then, a knife 60 or other suitable cutting instrument is projected through the opening 18 and utilized to cut a circular disc portion 62 from the tarpaulin 10 in order to form a ventilation opening therein registered with the opening 18. Thereafter, the cover 32 is gripped between the thumb and forefinger with the thumb and forefinger engaged in the indentations or recesses 54 and slightly squeezed, the cover being somewhat resilient. Thereafter, the cover is placed in position over the base 32 with the flanges 40 registered with the flanges 28 and pressed against the upper surface 24 of the base 16. Then, digital pressure may be released in order to allow the flanges 40 to slide beneath the flanges 28, each pair of pins 42 being spaced outward of the end of the corresponding flange 28 and limiting angular displacement of the cover 32 relative to the base 16 inasmuch as the pins 42 are abuttingly engageable with the opposite ends of the corresponding flanges 28.

The base 16 includes an outstanding cyclindrical flange 66 which extends outward therefrom about the opening 18 and the flange 66 and shield 48 serve to prevent water from entering the ventilation openings 38 from entering the opening 18. The lugs 52 and flanges 30 serve to maintain substantial portions of the outer periphery of the cover 32 in spaced relation relative to the opposing surfaces of the base 16 and to thereby provide ample ventilation beneath the cover 32 in addition to the ventilation provided therefore by the ventilation openings 38. The frusto-conical configuration of the peripheral wall 36 creates a negative pressure outward of the end wall 32 as breezes blow across the tarpaulin 10 and the spacing between peripheral wall 36 and the upper surface 24 of the base 16 provide air inlet slots whereby portions of such breezes may enter beneath the peripheral portions of the cover 32.

The flanges 30 not only serve to maintain the desired spacing between the peripheral wall 36 and the upper side 24 of the base 16, but also to prevent lateral shifting of the cover 32 relative to the base 16 in a direction transverse to the diameter of the base 16 centered relative to the flanges 28.

The base 16 and cover 32 are constructed of shape retentive but somewhat resilient plastic with the thickness of the base 16 being greater than the thickness of the cover 32. Accordingly, the cover 32 is somewhat more flexive than the base 16.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A ventilator for a panel having a vent opening formed therethrough, said ventilator including a generally annular panel-like base for overlying and anchoring to one side of said panel, said base having a central opening therein and defining first and second remote sides with said first side of said base adapted to be mounted in at least reasonably good fluid tight sealed engagement with the portions of said panel extending about the vent opening formed in said panel, a cup-shaped cover defining a closed end, an open end and peripheral wall means extending about said closed end and between said closed end and said open end, said cover being constructed of a material rendering said cover shape retentive, but flexible and resilient to an extent that predetermined remote portions of said peripheral wall means, adjacent said open end, may be manually deflected inwardly and thereafter released for inherent return to non-inwardly deflected positions, said open end of said cover opposing and opening toward said second side of said base, said base and predetermined remote portions of said peripheral wall means including coacting anchor structure interlockingly engageable with each other upon return of said inwardly deflected portions of said wall means to their non-inwardly deflected positions, said cover including ventilation openings formed in said closed end, said coacting anchor structure including first radially outwardly projecting flanges carried by remote portions of said peripheral wall means adjacent said open end and second angle flanges carried by remote portions of said base and projecting outwardly from said second side and toward each other, said first flanges being removably captively receivable beneath said second flanges upon inward deflection of said remote portions of said peripheral wall means and subsequent release of said peripheral wall means remote portions for return to non-inwardly deflected positions.

2. The ventilator of claim 1 wherein said peripheral wall means is generally frusto-conical with the minor diameter end thereof being disposed adjacent said closed end.

3. The ventilator of claim 1 wherein said open end includes means supporting at least a majority of the periphery of said open end in slightly spaced relation relative to said second side of said base.

4. The ventilator of claim 4 including an outstanding peripheral flange extending about said central opening and projecting outwardly of said second side of said base.

5. The ventilator of claim 4 wherein said peripheral wall means is generally frusto-conical with the minor diameter end thereof being disposed adjacent said closed end.

6. The ventilator of claim 2 wherein said predetermined remote portions of said wall means include outwardly opening recesses formed therein to facilitate gripping of said predetermined remote portions of said peripheral wall means between the thumb and forefinger of a hand.

7. The ventilator of claim 1 wherein said first side of said base includes an adhesive layer thereon for adhesively securing said first side of said base upon the outer side of said panel.

8. The ventilator of claim 2 wherein the central area of said closed end includes an inwardly projecting shank, the inner end of said shank supporting a disc-shaped shield therefrom closely overlying said center opening of said base.

9. The ventilator of claim 8 wherein said open end includes means supporting at least a majority of the periphery of said open end in slightly spaced relation relative to said second side of said base.

10. The ventilator of claim 9 including an outstanding peripheral flange extending about said central opening and projecting outwardly of said second side of said base.

11. The ventilator of claim 10 wherein said predetermined remote portions of said wall means include outwardly opening recesses formed therein to facilitate gripping of said predetermined remote portions of said peripheral wall means between the thumb and forefinger of a hand.

12. The ventilator of claim 11 wherein said first side of said base includes an adhesive layer thereon for adhesively securing said first side of said base upon the outer side of said panel.

13. The ventilator of claim 1 wherein said first and second flanges are arcuate with the center of curvature thereof substantially centered relative to the interior of said cover, said first flanges being of greater angular extent than said second flanges, the opposite ends of said first flanges including outstanding projections disposed outwardly of and engageable with the arc ends of said second flanges and preventing angular displacement of said cover relative to said base.

* * * * *